United States Patent [19]

Obata

[11] 4,263,483

[45] Apr. 21, 1981

[54] MOVING COIL PICK-UP ASSEMBLY FOR USE IN A RECORD PLAYER

[75] Inventor: Shuichi Obata, Kyoto, Japan

[73] Assignee: Matsushita Electric Industrial Co., Ltd., Osaka, Japan

[21] Appl. No.: 938,308

[22] Filed: Aug. 29, 1978

[30] Foreign Application Priority Data

Sep. 1, 1977 [JP] Japan ..... 52-105534

[51] Int. Cl.[3] ..... H04R 9/16

[52] U.S. Cl. ..... 369/139; 369/147

[58] Field of Search ..... 179/100.41 D, 100.41 K, 179/100.41 Z; 274/37

[56] References Cited

U.S. PATENT DOCUMENTS

| | | | |
|---|---|---|---|
| 2,034,872 | 3/1936 | Keller | 179/100.41 D |
| 3,694,586 | 9/1972 | Grado | 179/100.41 Z |
| 3,729,596 | 4/1973 | Toth | 179/100.41 K |
| 3,761,647 | 9/1973 | Nemata | 179/100.41 K |

FOREIGN PATENT DOCUMENTS

| | | | |
|---|---|---|---|
| 1135675 | 8/1962 | Fed. Rep. of Germany | 179/100.41 ST |
| 2555846 | 7/1976 | Fed. Rep. of Germany | 179/100.41 Z |
| 43-21243 | 12/1968 | Japan | 179/100.41 Z |
| 1000035 | 4/1965 | United Kingdom | 179/100.41 K |

*Primary Examiner*—Bernard Konick

*Assistant Examiner*—Alan Faber

*Attorney, Agent, or Firm*—Wenderoth, Lind & Ponack

[57] ABSTRACT

A pick-up assembly carried by a tone arm itself or a cartridge adapted to be connected to the tone arm includes a vibrating section and a magnetic circuit section. The vibrating section has a cantilever having one end carrying a stylus and the other end mounted in a support ring. A pair of ring-shaped moving coils are mounted on the support ring in such a manner that the longitudinal axes of the coils are in parallel and equidistantly spaced relation to the longitudinal axis of the support ring so that the coils are angularly spaced at right angles to each other about the longitudinal axis of the support ring. The magnetic circuit section has a permanent magnet sandwiched between front and rear yokes of magnetic material. The front yoke has a pair of leg portions extending downwardly for positioning the coils in spaced relationship between the leg portions while the rear yoke has a cylindrical support member carrying the support ring in such a manner as to allow the vibrating section to flex angularly and a pair of poles of magnetic material rigidly connected to the cylindrical support member and the rear yoke. Free end portions of the poles remote from the rear yoke are coaxially inserted into the coils respectively for forming a magnetic field between each pole and its corresponding leg portion. A recess in the front yoke improves the separation between the audio channels.

10 Claims, 18 Drawing Figures

MOVING COIL PICK-UP ASSEMBLY FOR USE IN A RECORD PLAYER

BACKGROUND OF THE INVENTION

The present invention relates to a pick-up assembly for use in a record player and, more particularly, to an improved pick-up assembly for use in stereophonic reproduction having a stylus adapted to slidingly engage in a V-shaped information carrier groove formed a record disk, and a pair of moving coils which move or vibrate in a magnetic field according to the vibration of the stylus.

Conventionally, there have been proposed various pick-up assemblies of the above described type. For example, one type of pick-up assembly is disclosed in Japanese Utility Model Publication No. 19879/1965 published on July 12, 1965. This publication discloses a pick-up assembly as shown in FIGS. 1, 2 and 3 of the attached drawings, in which FIG. 1 is a side-sectional view of the pick-up assembly, FIG. 2 is a fragmentary end view of the pick-up coil assembly and FIG. 3 is a fragmentary side sectional view on an enlarged scale. As shown in FIG. 1, the pick-up assembly includes a permanent magnet 101. One end of this magnet 101 which is polarized in one polarity has a piece of yoke 102 extending downwardly therefrom while the other end which is polarized in the other polarity extends adjacent the yoke 102 through a pole piece 103. In this arrangement, a magnetic field is produced in a space between a free end portion of the yoke 102 remove from the permanent magnet 101 and the tip of the pole piece 103 adjacent the yoke 102, as best shown in FIG. 3. Provided in the space between the yoke 102 and the pole piece 103 is an armature 104 supported on the tip of the pole piece 103 through by a damper 109. A cantilever 108 having one end portion flexibly connected to the tip of the pole piece 103 extends through respective openings formed in the damper 109 and the armature 104, and then through an opening 110 formed in the free end portion of the yoke 102. The other end of the cantilever 108 remote from the pole piece 103 extends outwardly from the opening 110 and carries a stylus 107. Provided around the armature 104 are a pair of coils 105 and 106 which are separately wound around the armature and at right angles to each other, as best shown in FIG. 2. The stylus 107, cantilever 108, armature 104 and coils 105 and 106 constitute a vibrating section. The vibration of the stylus 107, caused by and in scanning engagement with the groove of the record disk which is moved relative to the stylus 107, is transmitted to the armature 104 so that an electric current indicative of the information carried in the groove of the record disk is induced in the respective coils 105 and 106. The above described pick-up assembly, however, has the following disadvantages.

(a) During the manufacturing process it is difficult to wind coils 105 and 106 around the armature or coil supporter 104 which is fixedly mounted on the cantilever 108 which carries the stylus 107. Therefore, it is difficult to produce a number of such assemblies in a simple assembly line. Furthermore, because the coils 105 and 106 wound around and on the supporter 104 come in contact with the damper 109, not only is it difficult to connect the damper 109 flatly to the supporter 104, but it is also difficult to position the damper 109 in a proper position between the pole piece 103 and the armature 104.

(b) For the purpose of improving the sensitivity, the armature 104 is made of a magnetic material. However, such magnetic material undesirably increases the effective mass of the vibrating section. Therefore, the reproduction band width is narrowed.

(c) Since the cantilever 108 must extend loosely through the yoke 102, it becomes necessary to form the opening 110 in the yoke 102 and it also becomes necessary to insert the cantilever 108 subsequently through the opening 110 during the manufacturing process. Furthermore, when it becomes necessary to change the stylus, the operation of removing the cantilever out from the opening 110 and again inserting the cantilever into the opening 110 has to be repeated. Therefore, it is not only difficult to manufacture the pick-up assembly described above in a simple assembly line, but also to later exchange the stylus. Moreover, the opening 110 tends to provide an obstacle to a desired or predetermined distribution of the magnetic field produced between the pole piece 103 and the yoke 102.

(d) Since the yoke 102 and the pole piece 103 are located closely adjacent to the surface of the record disk, a magnetic flux produced between the yoke 102 and the pole piece 103 may leak out to a magnetic material located thereabout such as a turn table. Therefore, magnetic attraction between the turn table and the yoke 102 or the pole piece 103 may cause an undesirable change in the contact pressure between the stylus and the record disk. Furthermore, for preventing the yoke 102 or pole piece 103 from magnetically attracting tiny ferrous particles, it becomes necessary to provide a shielding means such as a thin rubber sheet around the assembly or around the yoke 102 and pole piece 103.

Another type of pick-up assembly is disclosed in Japanese Patent Application No. 5677/1971 which was laid open to public inspection on Dec. 1, 1971. This application discloses a pick-up assembly as shown in FIGS. 4 and 5 of the attached drawings, in which FIG. 4 is a side view of the pick-up assembly with a portion broken away, and FIG. 5 is a fragmentary end view of the pick-up assembly. As shown in FIG. 5, a pair of sector-shaped coils 111 and 112, each wound in, are supported by a coil supporter 117 which is fixedly mounted on a cantilever 118 carrying a stylus 116. These coils 111 and 112, supporter 117, cantilever 118 and stylus 116 make up a vibrating section. Effective portions of the coils 111 and 112, that is, arcuate portions 111*a* and 112*a* are positioned in spaced relationship between magnets 113 and 114 where a magnetic field is produced. The coils 111 and 112 are vibrated according to the vibration of the stylus 116 so as to generate a current in the coils 111 and 112. The above described pick-up assembly, however, has the following disadvantages.

(e) For the purpose of improving the sensitivity, each of the coils 111 and 112 is so arranged as to position the arcuate position 111*a* or 112*a* in the magnetic field where the magnetic flux is densely distributed. However, this arrangement requires the formation of an elongated portion in each of the coils 111 and 112 which is not affected by the magnetic field. Therefore, the size of each of the coils 111 and 112 is comparatively large and thereby increases the effective mass of the vibrating section. The increased mass of the vibrating section causes a reduction in reproduceability at a high frequency range and, at the same time, the mechanical impedance is increased. Therefore, the reproduction frequency range, that is, the range of frequency which the pick-up assembly can reproduce, is narrowed. Furthermore, since the coil portion which is supported by the supporter 17, that is, where it is not affected by the magnetic field, is comparatively long, the coil may not be rigid enough to eliminate undesired resonance. Moreover, since the coils 111 and 112 are located closely adjacent to each other, each of the coils may be influenced by the other coil to such an extent as to cause crosstalk therebetween.

(f) Since the coils 111 and 112 are comparatively large, the wire necessary to make up each of the coils will be comparatively long. Therefore, the resistance of each of the coils will increase to such an extent as to produce undesirable thermal noise or increase an equivalent input impedance to an amplifier to be connected to the pick-up assembly and thereby causing a production of other noises.

(g) Since the coils 111 and 112 are made in sector shape which is not of point symmetry, it is difficult to produce the coils in a simple assembly line and, at the same time, it becomes difficult to mount such coils in a proper position on the supporter 117.

SUMMARY OF THE INVENTION

Accordingly, a primary object of the present invention is to provide an improved pick-up assembly which can be assembled accurately in a simple factory assembly line and at the same time be of high quality.

Another object of the present invention is to provide an improved pick-up assembly which is smaller in size thereby reducing the effective mass of its vibrating section so as to widen the reproduction frequency range, particularly in the high frequency range, and to reduce the mechanical impedance particularly in the high frequency range.

Yet another object of the present invention is to provide an improved pick-up assembly which employs coils of relatively low inductance and also of relatively low resistance and a magnetic circuit of relatively high magnetic flux density so that not only can a relatively large ratio of output sensitivity to impedance be attained, but also a relatively high S/N ratio can be attained with a consequent reduction in noises.

A further object of the present invention is to provide an improved pick-up assembly which employs pure moving coils without any magnetic loss in the magnetic core, the loss being caused by eddy current loss in the core material on which the coils are wound, in the frequency audible range and to prevent magnetic distortion caused by disturbing the magnetic flux flow in the magnetic gaps.

A still further object of the present invention is to provide an improved pick-up assembly in which coils and magnetic poles are arranged in a simple geometric arrangement so as to reduce the crosstalk of the coils as much as possible.

A further object of the present invention is to provide an improved pick-up assembly which can be readily manufactured in uniform quality and performance characteristics because of the employment of the coils, each having a simple shape, and a supporter for these coils.

A further object of the present invention is to provide an improved pick-up assembly in which the leakage of the magnetic flux from the magnetic circuit is minimized to substantially avoid any development of a magnetic attraction between the magnetized material and magnetic material such as the turn table so that the pick-up stylus engages in the record groove under an optimum and constant stylus pressure.

Still another object of the present invention is to provide an improved pick-up assembly in which the vibrating section and a portion of the magnetic circuit is formed in a unitary block for the easy exchange of the stylus.

Still another object of the present invention is to provide an improved pick-up assembly which is simple in construction and can be readily manufactured.

In accordance with a preferred embodiment of the invention, a pick-up assembly is provided having a vibrating section and magnetic circuit section. The vibrating section comprises a cantilever having one end portion thereof provided with a stylus, a support ring is rigidly mounted on the other end of the cantilever in substantial alignment with the longitudinal axis of the cantilever and a pair of ring-shaped coils are rigidly mounted on the support ring. The longitudinal axes of the coils extend in parallel and are equidistantly spaced in relation to the longitudinal axis of the support ring while the coils are angularly spaced at substantially right angles to each other about the longitudinal axis of the support ring. The respective planes of the ring-shaped coils are contained in a plane perpendicular to the axis of the support ring.

The magnetic circuit section comprises a damper means, a supporting means for supporting the support ring through the damper means such that the coils can vibrate approximately at a point of intersection of the longitudinal axis of the support ring with the plane of the coils in accordance with the vibration of the cantilever caused by the stylus which is sliding along the groove of the record disk, a pair of poles made of magnetic material each coaxially extending through the corresponding coil, and a front yoke member made of magnetic material and having a recess defined at one edge thereof to provide a pair of leg portions. The front yoke member is positioned with the recess located above the pair of poles in spaced relation to the coils for forming a pair of magnetic gaps of a predetermined dimension between each of the poles and the respective leg portions. The magnetic circuit section further comprises means for presenting one of opposite magnetic polarities to the pair of poles and the other magnetic polarity to the leg portions for establishing a magnetic field between each of the poles and the respective leg portions.

BRIEF DESCRIPTION OF THE DRAWINGS

These and other objects and features of the present invention will become apparent from the following description taken in conjunction with preferred embodiments thereof with reference to the accompanying drawings, in which.

DETAILED DESCRIPTION OF THE INVENTION

Figure 1:
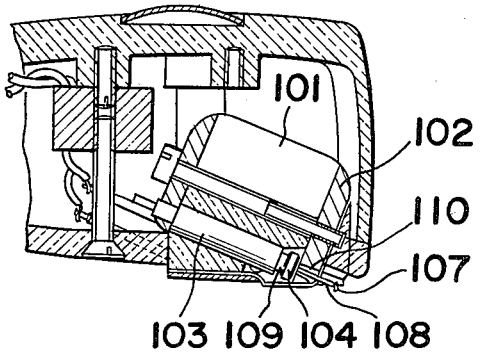
Fig. 1 PRIOR ART
FIGS. 1 to 5 have already been referred to in the foregoing description, FIG. 1 being a side-sectional view of the conventional pick-up assembly, FIG. 2 being a fragmentary end view of the pick-up assembly shown in FIG. 1, FIG. 3 being a fragmentary side sectional view, on an enlarged scale, of the pick-up assembly shown in FIG. 1, FIG. 4 being a side view of another conventional pick-up assembly with a portion broken away, and FIG. 5 being a fragmentary end view of the pick-up assembly shown in FIG. 4.
Figure 2:
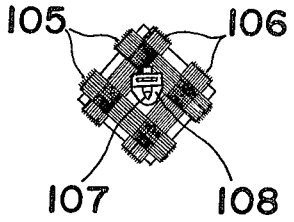
Fig. 2 PRIOR ART
Figure 3:
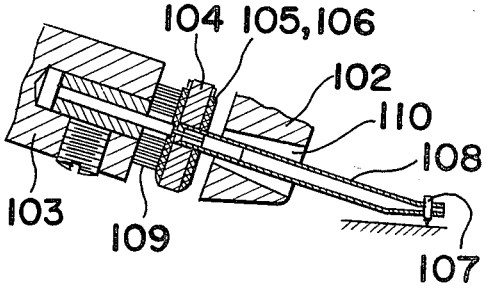
Fig. 3 PRIOR ART
Figure 4:
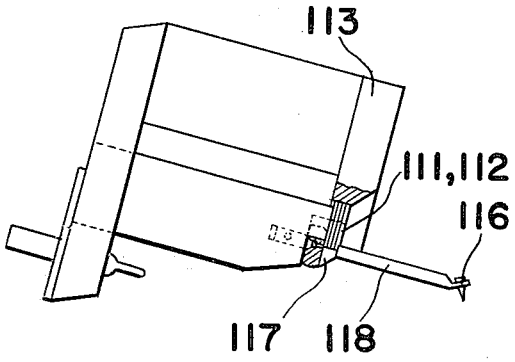
Fig. 4 PRIOR ART
Figure 5:
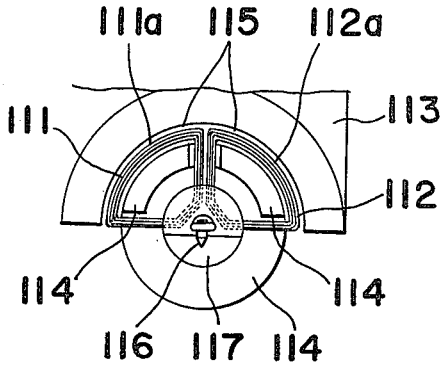
Fig. 5 PRIOR ART

Before the description of the present invention proceeds, it is to be noted that like parts are designated by like reference numerals throughout the accompanying drawings.

Figure 6:
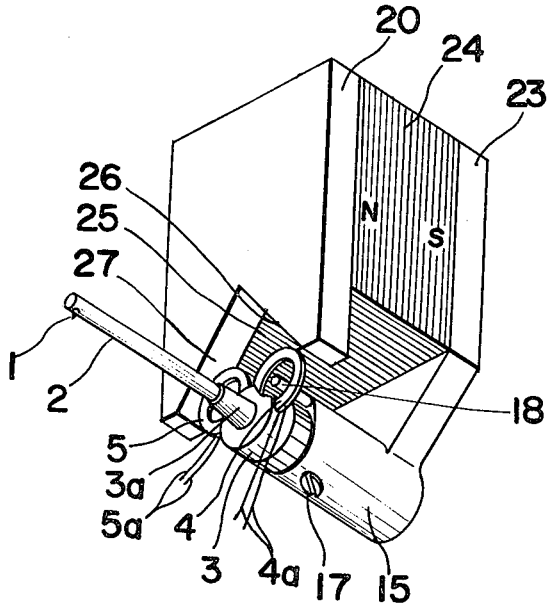
FIG. 6 is a perpsective view of a pick-up assembly of the present invention.
Figure 11:
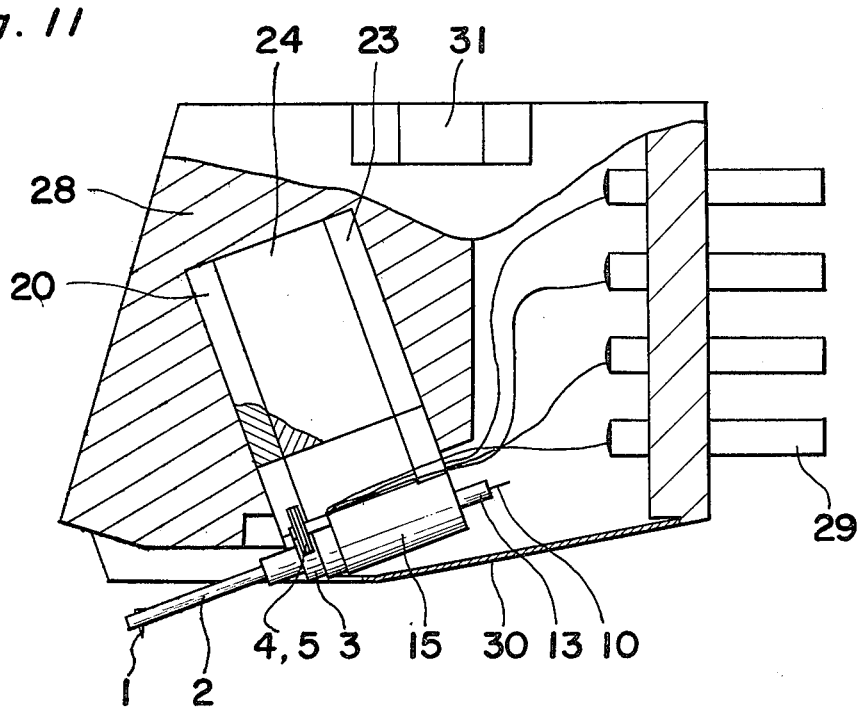
FIG. 11 is a side view, with a portion broken away of a pick-up cartridge employing the pick-up assembly shown in FIG. 6.

Referring now to FIG. 6, there is shown one embodiment of a pick-up assembly of the present invention which is provided for reproducing two or more groups of sound information carried independently in a spiral groove formed in a stereophonic record disk through a so-called 45—45 system. The pick-up assembly of the present invention can be supported by a support which may be the tone arm (not shown) itself or a cartridge, as shown in FIG. 11, adapted to be connected to a tone arm (not shown). The pick-up assembly formed in two sections. These sections are a vibrating section and a magnetic circuit section. The description hereinbelow is first directed to the vibrating section.

Referring to the drawings, the vibrating section comprises a pick-up stylus 1 carried at one end or the front end portion of a cantilever 2, a support ring 3 fixedly supporting the other end of rear end of the cantilever 2 and a pair of moving coils 4 and 5. The support ring 3 is carried by a magnetic circuit section as will be described in detail later.

Figure 7:
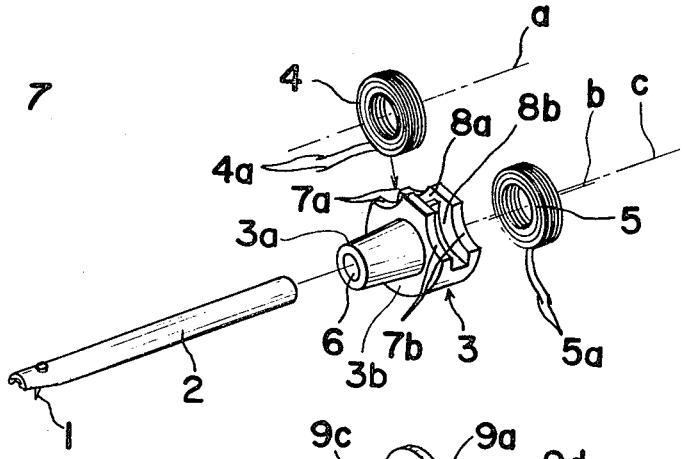
FIG. 7 is an exploded view of a vibrating section of the pick-up assembly shown in FIG. 6.
Figure 9:
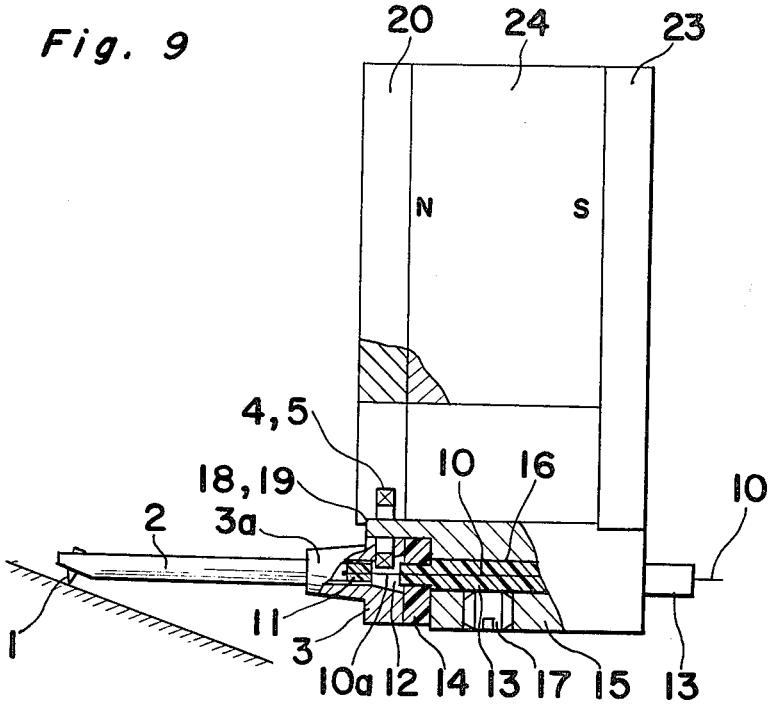
FIG. 9 is a side view, with a portion broken away, of the pick-up assembly shown in FIG. 6.

Referring to FIG. 7, the support ring 3, which is of a one-piece construction and made of any suitable material, for example, synthetic resin, reinforced plastic such as carbon-filter reinforced or glass-fiber reinforced synthetic resin, or metal such as aluminum and magnesium, has a ring portion 3*b* and a cylindrical projection 3*a* coaxially protruding from a front end face of the ring portion 3*b*. A cylindrically shaped hole 6 is formed in the support ring 3 and extends completely through the entire length of the ring 3 with the longitudinal axis of the hole 6 aligned with the axis c of the support ring 3. The hole 6 gradually increases in diameter beginning at an intermediate portion thereof towards the rear surface of the ring portion 3*b*, as best shown in FIG. 9. The rear end of the cantilever 2 which is opposite the front end portion is tightly inserted into the hole 6 by an amount approximately equal to the length of the projection 3*a*, as best shown in FIG. 9, so as to align the axis of the cantilever with the axis c of the support ring 3. The ring portion 3*b* of the support ring 3 has a pair of arcuate grooves 8*a* and 8*b* located in the peripheral edge portion thereof having pairs of opposite walls 7*a* and 7*b*, respectively. The coils 4 and 5 are tightly mounted in the grooves 8*a* and 8*b*, respectively, and secured in position by the application of a suitable securing means such as a bonding agent of epoxy resin adhesive.

Each of the coils 4 and 5 is mode of insulated wire having a diameter of 15 μm to 40 μm wound into a ring shape. Lead wires 4*a* and 5*a* extending from the coils 4 and 5 are provided for external electric connection thereof. For the purpose of maintaining the ring shape, the coils 4 and 5 are impregnated with a hardening agent or are formed of bonding-agent coated wires. The wire is wound in the shape of a ring so that each of the resulting coils 4 and 5 will have the smallest possible diameter thereby reducing the weight and internal resistance of the coils 4 and 5. Moreover, as a result of each of the coils 4 and 5 is being ring-shaped, weakening of the coil, the weakening being a cause of resonance in the coil, can be minimized.

Figure 10:
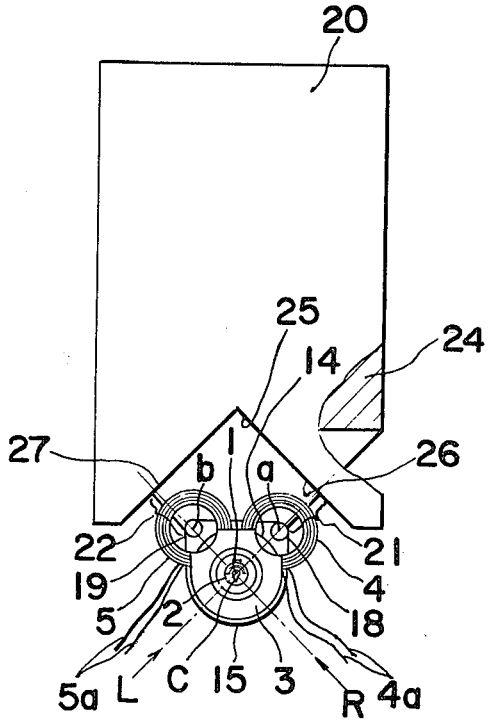
FIG. 10 is a front end view of the pick-up assembly shown in FIG. 6.

The above described coils 4 and 5 are inserted in the grooves 8*a* and 8*b* so that the longitudinal axes a and b of the coils 4 and 5 are in parallel and equidistantly spaced relation to the longitudinal axis c of the cylindrical projection 3*a*. Accordingly, the coils 4 and 5 are angularly spaced at exactly right angles to each other about the longitudinal axis c of the cylindrical projection 3*a*, as best shown in FIG. 10.

Figure 8:
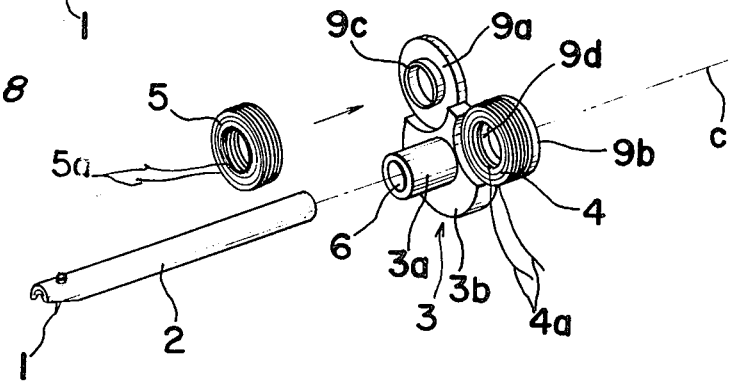
FIG. 8 is a view similar to FIG. 7, but showing a modification of FIG. 6.

Referring to FIG. 8, there is shown a modified form of the support ring 3. Instead of forming grooves in the ring portion 3*b* of the support ring 3 as described above with reference to FIG. 7, a modified support ring 3 is provided which is integral with a pair of ring shaped plates 9*a* and 9*b* each having a ring-shapedd rib 9*c* or 9*d* extending coaxially from a circular opening in the ring-shaped plate. The coils 4 and 5 are mounted on the ring-shaped plates 9*a* and 9*b*, respectively, and are secured in position by the application of a suitable securing means such as a bonding agent.

Referring again to FIG. 6, the magnetic circuit section of the pick-up assembly comprises a permanent magnet 24 having a cubic shape and having N and S poles at its opposite flat surfaces, and front and rear yokes 20 and 23 on the respective sides of and respectively secured to the N and S pole surfaces of the permanent magnet 24. These front and rear yokes 20 and 23 are made of magnetic material so that they can be magnetized by the N and S poles as a result of being in contact with the N and S pole surfaces of the magnet 24, respectively.

The front yoke 20 has a bottom side extending outwardly from the bottom surface of the permanent magnet 24 and has a V-shaped recess 25 defined by a pair of slanted surfaces 26 and 27 which provide a pair of leg portions. The slanted surfaces 26 and 27 are angularly spaced at right angles to each other. The rear yoke 23 also has a bottom side extending outwardly from the bottom surface of the permanent magnet 24 and carries a cylindrical supporting member 15 fixedly secured thereto or integrally formed therewith. This supporting member 15 is also made of a magnetic material such as pure iron or permedur. This cylindrical supporting member 15 which is carried by the yoke 23 protrudes outwardly from the bottom side of the yoke 23 and terminates adjacent the front yoke 20.

The cylindrical supporting member 15, as shown in FIGS. 6 and 10, is integrally or fixedly provided with two poles 18 and 19 protruding from a front end face of the cylindrical supporting member 15 which is located adjacent the front yoke 20. The two poles 18 and 19 are made of magnetic material so that these poles 18 and 19 can be magnetized to be a S pole, and are provided on the cylindrical supporting member 15 so that the longitudinal axes of these poles are parallel and equidistantly spaced from the longitudinal axis of the cylindrical supporting member 15 and the poles 18 and 19 are angularly spaced exactly at right angles to each other about the longitudinal axis of the cylindrical supporting member 15. Furthermore, one side edge of the pole 18 and the slanted surface 26 are in face-to-face relation with each other and are spaced a predetermined distance from each other. In the same manner, one side edge of the pole 19 and the slanted surface 27 are in face-to-face relation with each other and are spaced the same predetermined distance from each other. Accordingly, as shown in FIG. 10, a strong magnetic field is established in a gap 21 between the pole 18 and the slanted surface 26 and also in a gap 22 between the pole 19 and the slanted surface 27.

The cylindrical supporting member 15 further has a hole 16 defined therein and extending coaxially along the longitudinal axis of the cylindrical supporting member 15. A support pipe 13 is inserted in the hole 16. A screw 17 is adjustably received at an intermediate portion of the cylindrical supporting member 15 and is used to fix the support pipe 13, which has been inserted in the hole 16, in position. A ring-shaped damper 14 made of viscoelastic material such as butyl rubber is placed on the front end face of the cylindrical supporting member 15 which is adjacent the front yoke 20.

The connection between the vibrating section and the magnetic circuit section is carried out by a string 10 made of a metallic wire or a synthetic resin filament in a manner described herinbelow with reference to FIG. 9.

As best shown in FIG. 9, the string 10 has one end coaxially inserted into and fixed in position by a suitable connecting element 11 on the rear end of the cantilever 2, which is fixed in the hole 6 in the support ring 3, and the other end terminating outside of the rear end of the support pipe 13 remote from the cantilever 2 after being passed completely through the support pipe 13. The assembly of the cantilever 2 and support ring 3 can be connected to the cylindrical supporting member 15 by fastening the screw 17 after the end of the string 10, which is remote from the cantilever 2 has been pulled outwards to hold the string 10 under a predetermined tension with the damper 14 compressed in contact between the rear end face of the support ring 3 and the front end face of the cylindrical supporting member 15.

The extent to which the damper 14 is compressed, which is affected by the predetermined tension of the string 10, is selected so that the assembly of the cantilever 2 and support ring 3 can, when the cantilever 2 undergoes a vibration with the stylus 1 engaged in the spiral groove of the record disc, be displaced in all directions in harmony with the vibration of the cantilever 2 substantially about a portion 10*a* of the tensioned string 10 which extends through a large-diameter portion 12 of the hole 6 in the support ring 3. Thus, the pick-up assembly so constructed is accommodated in a tone arm or a cartridge, as shown in FIG. 11.

In FIG. 11, the cartridge comprises a housing 28 having a recess for accommodating the pick-up assembly, shielding plate 30 for shieldig the pick-up assembly accommodated in the cartridge, four terminal pins 29 each connected to one of lead wires 4*a* and 5*a* extending from the coils 4 and 5 and a mounting means 31 for the support of a head shell (not shown) to be mounted on the cartridge. The description which follows is directed to the movement of the vibrating section in relation to the magnetic circuit section.

Referring to FIG. 10, when the pick-up assembly is playing a stereophonic record disk, the stylus 1 is vibrated according to the indentations formed in the groove of the disk. The groove of the record disk has a V-shaped cross section defined by a pair of slanting walls which are approximately at right angles to each other. The indentations formed in one of the slanted walls carry modulated audio information for the left channel and the indentations formed in the other slanted wall carry modulated audio information for the right channel. When the stylus 1 is vibrated in a direction indicated by arrow L in harmony with the indentations in the left channel slanted wall of the groove, the cantilever 2 is also vibrated about a neck portion 10*a* (FIG. 9) of the string 10 so that the coil 4 is vibrated in the longitudinal axial direction. In other words, the vibration of the coil 4 is such that the coil 4 rotates a small degree about a line extending in the direction indicated by arrow R. Therefore, the coil 4 cuts the magnetic flux established in the gap 21 to generate current which is indicative of the information carried in the left channel slanted wall. It is to be noted that during this vibration of the stylus 1 in the direction L the coil 5 merely rotates about the line which extends in the R direction. Therefore, the coil 5 generates substantially no current during this rotation.

In a similar manner, when the stylus 1 is vibrated in the R direction by the indentations of the right channel slanted wall, the cantilever 2 is vibrated about the neck portion 10*a* so that the coil 5 is vibrated so as to make a rotation about the line extending in the L direction. Therefore, only the coil 5 generates the current which is indicative of the information carried in the right channel slanted wall.

According to a preferred embodiment, the vibrating section is adjusted so as to allow the neck portion 10*a* to extend through an imaginary plane which includes the centers of the coils 4 and 5, so that the vibration of the cantilever 2 is effectively transmitted to the coils 4 and 5.

It is to be noted that the permanent magnet 24 is preferably made of a material, such as samarium-cobalt, which has a high magnetic coercive force and a high residual flux density for establishing a high magnetic field in the gaps 21 and 22. Furthermore, such a magnet is comparatively light in weight. Therefore, the mass of the cartridge can be reduced to obtain a suitable tone arm resonance frequencies at low frequency.

It is also to be noted that the front and rear yokes 20 and 23 and the supporting member 15 including the poles 18 and 19 are made of a magnetic material such as ferrite or permedur or pure iron having a high saturation magnetization and a high magnetic permeability, the preparation of which may be the use of a powder molding and sintering technique. Particularly, it is preferable to form the pins 18 and 19, as well as the front yoke 20, by the use of the method of sintering so that such parts can be manufactured with accuracy and the number of manufacturing steps can be reduced. Other known forming methods such as press forming can be applied.

Figure 12:
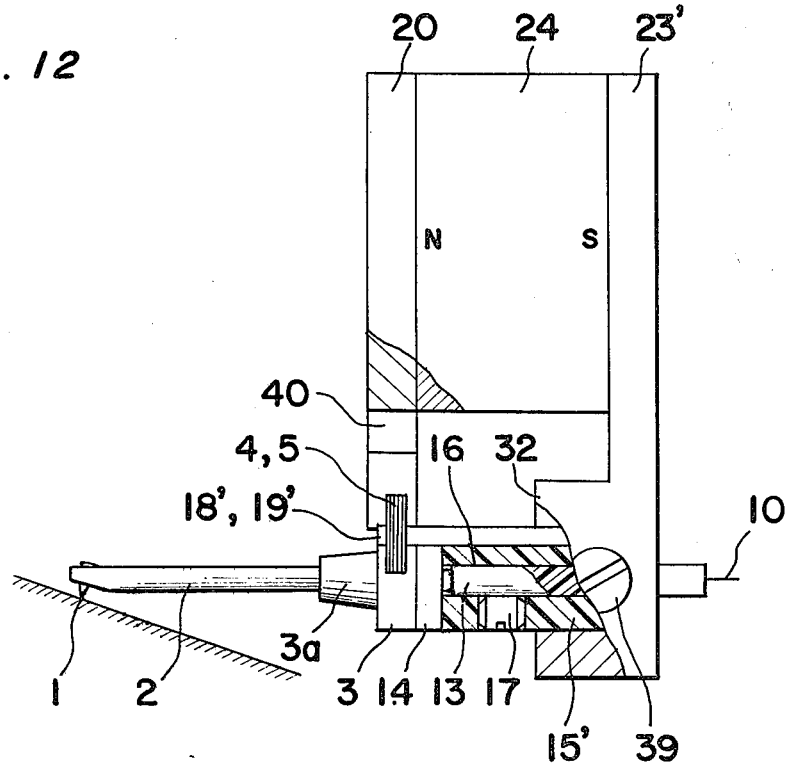
FIG. 12 is a view similar to FIG. 9, but particularly showing a modification of FIG. 9.

Referring now to FIG. 12, there is shown a pick-up assembly which is a modification of the pick-up assembly shown in FIG. 9. In FIG. 9, the rear yoke 23, cylindrical supporting member 15 and poles 18 and 19 have been described as being integrally composed of the magnetic material. In this modification however, these elements are provided separately. The detail of these elements are shown in FIG. 13 in which the corresponding parts are designated by reference numerals which corresponds to those of FIG. 9, but with a prime.

Figure 13:
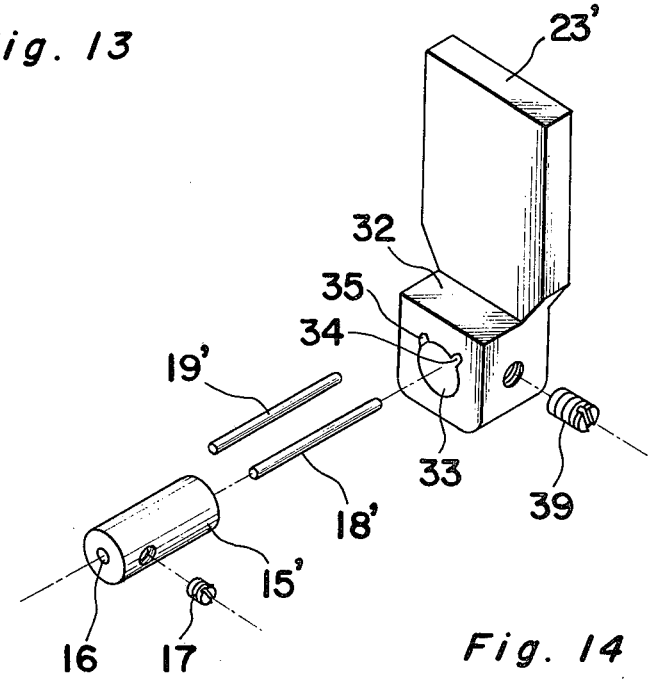
FIG. 13 is an exploded view of a rear panel employed in the pick-up assembly shown in FIG. 12.

Referring to FIGS. 12 and 13, a rear yoke 23' has a block portion 32 integrally formed at the bottom side thereof. The cubic block portion 32 has a cylindrical hole 33 which extends perpendicularly to the plane surface of the rear yoke 23' so as to tightly receive a cylindrical supporting member 15' made of either magnetic material or non-magnetic material. It is to be noted that in this case the supporting member 15 is not necessarily made of magnetic material because the magnetic flux passes through the poles 18' and 19'. The hole 33 has grooves 34 and 35 at a upper side in parallel relation to the hole 33 for receiving rods 18' and 19' which are made of magnetic material and which functionally correspond to the poles 18 and 19 which are described in the foregoing embodiment. After the cylindrical supporting member 15' has received the support pipe 13, the supporting member 15' is inserted into the hole 33 and at the same time the rods 18' and 19' are also inserted into the grooves 34 and 35. This cylindrical supporting member 15' and the rods 18' and 19' are fixedly secured in the inserted position, as shown in FIG. 12, by a screw 39 which is threaded into an opening formed in the side of the block portion 332 or by an adhesive material.

According to the above described modification, the S pole of the permanent magnet 24 is transmitted through the rear panel 23' and cubic block portion 32 to the front end of the rods 18' and 19'. Since the cylindrical supporting member 15' is provided separately and the entire vibrating section is previously assembled, it is quite simple to assemble the pick-up assembly.

In order to improve the separation of the audio information between those for the left and righ channels it becomes necessary to carefully arrange the pick-up assembly with regard to the geometrical positioning of the vibrating section when it interacts with the configuration of the recess 25 formed in the front panel 20. The geometrical positioning is described as follows.

As shown in FIG. 10, it is necessary to position the center of the coil 4 so that it is aligned with a line extending between the center a and the stylus 1 with the direction L corresponding to the movement of the stylus 1 effected by the indentations of the left channel slanted wall of the record disk groove. In a similar manner, it is necessary to position the coil 5 so that it is aligned with a line extending between the center b and the stylus 1 with the direction R corresponding to the movement of the stylus 1 effected by the indentations of the right channel slanted wall of the record disk groove. Since the slanted walls forming the V-shaped groove of the record disk are in right-angled-relation to each other, it is necessary to extend the first and second mentioned lines at right angles to each other. In the case where the stylus 1 is vibrated in the direction L (or R), the coil 4 (or 5) is vibrated back and forth along the axis a (or b) thereof to generate current only in the vibrated coil, as described above. In the case where the stylus 1 is vibrated up and down perpendicularly to the plane of the record disk, the current generated from the coil 4 and the current generated from the coil 5 have exactly the same pattern, the same phase and the same amplitude to each other. On the other hand, in the case where the stylus 1 is vibrated sideways in parallel relation to the record disk, the current generated from the coil 4 and the current generated from the coil 5 have the same pattern and the same amplitude, but are in opposite phase to each other. In this case, in order to obtain the same phase, the connection of the external lead lines of one of the coils may be connected to the terminal pins in opposite relation to the other coil.

Now the configuration of the recess 25 formed in the front yoke 20 is described. In order to improve the separation of the audio information between the left and right channels, the magnetic flux produced in the gap between the slanted surface and the pole should be greatest along the lines extending in the directions L and R. In order to meet this requirement, the area of the slanted surface is reduced by forming a rectangular recess 40 at the edges where the slanted surfaces 26 and 27 are connected, as shown by dotted line in FIGS. 6 and 10. The recess 40 reduces the magnetic flux produced in a vertical direction (a direction perpendicular to the record disk) and increases the magnetic flux produced in a horizontal direction (a direction parallel to the record disk). Therefore, the magnetic flux is most dense in the L and R directions while at the same time the crosstalk between the left and right channels is reduced.

Figure 14:
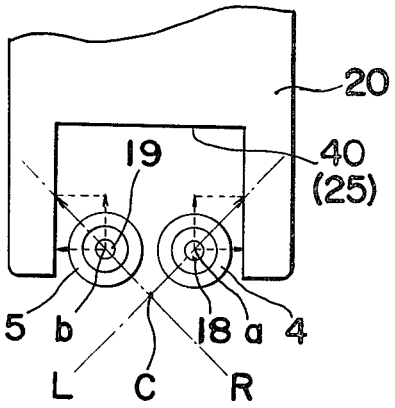
FIG. 14 is a diagram showing a principle of distribution of magnetic flux influenced by a rectangular recess.

For a better understanding of recess 40, one extreme example is shown in FIG. 14. As the depth of the recess 40 becomes deeper, the magnetic flux in the vertical direction is reduced and, as the width between the side surfaces of the recess 40 becomes smaller, the mgnetic flux in the horizontal direction is increased. Therefore, by adjusting the size of the rectangular recess 40, it becomes possible to provide the highest magnetic flux in the L and R directions as shown by a dotted vector arrow.

Figure 15:
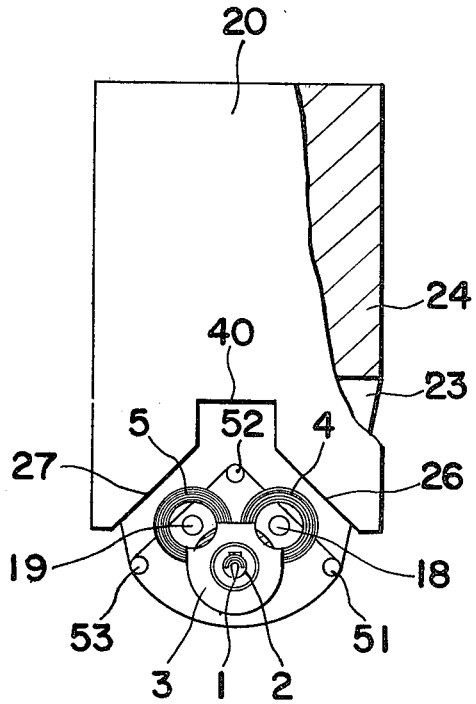
FIG. 15 is a view similar to FIG. 10, but particularly showing a modification of FIG. 10.

Referring now to FIG. 15, for increasing the magnetic flux or optimizing the flux direction between the slanted surfaces 26 and 27 and poles 18 and 19, respectively, auxiliary poles 51, 52 and 53 may be provided on the supporting member 15 in the manner described hereinafter. The poles 51, 52 and 53 are added and are separate from the pole 18. Each of the auxiliary poles 51, 52 and 53 is in the form of a pin made of magnetic material and is magnetically connected to the rear yoke 23 to have the same polarity, such as the S pole, as the polarity of the poles 18 and 19 at the respective end portions of the auxiliary poles.

Figure 16:
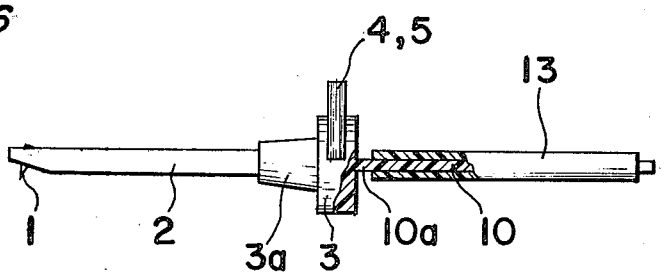
FIG. 16 is a side view, with a portion broken away, of a vibrating section carried by a string means which is a modification of the string means shown in FIG. 9.
Figure 17:
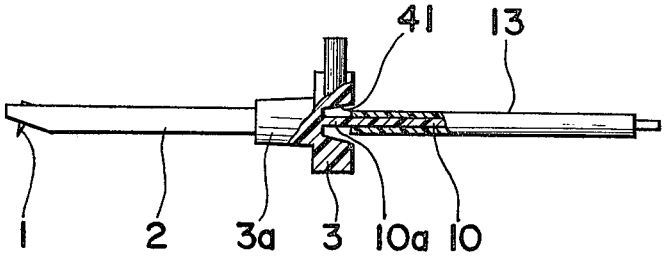
FIG. 17 is a view similar to FIG. 16, but particularly showing another modification thereof.

Referring to FIGS. 16 and 17, there is shown the support ring 3 which is integral with the string 10 and made of synthetic resin. Particularly in FIG. 17, the string 10 extends from a bottom of an annular recess 41 located in the rear surface of the support ring 3 while the support pipe 13 has the front end portion partly inserted into the recess 41, in a similar manner as described above with reference to FIG. 9, so as to have the neck portion **10*a* of the string 10 located within or close to the imaginary plane surface which includes the centers of the coils 4 and 5**.

Figure 18:
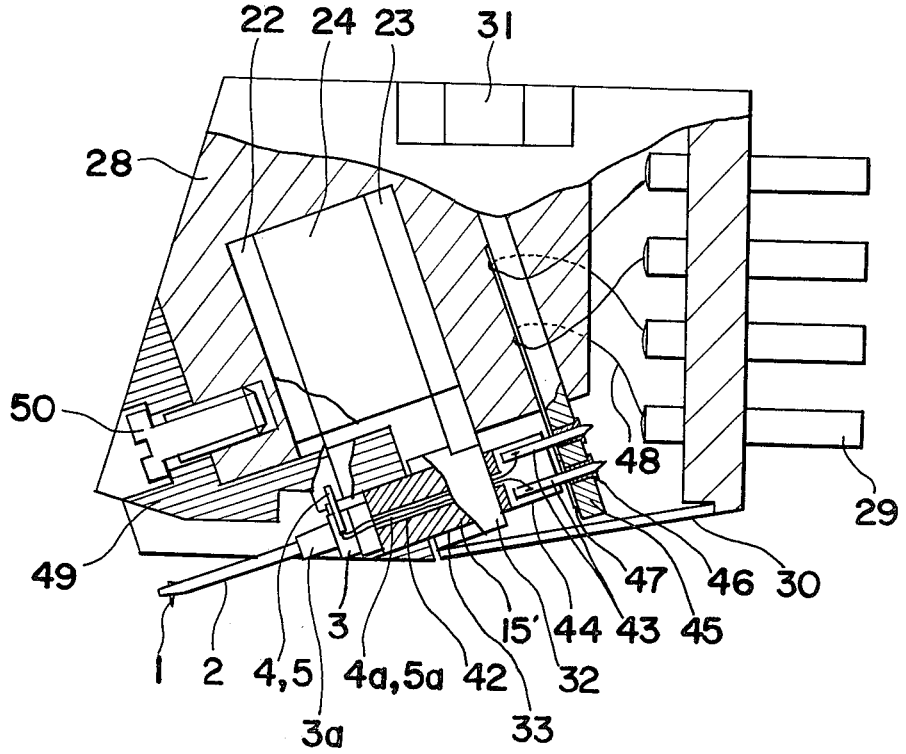
FIG. 18 is a view similar to FIG. 11, but particularly showing a modification thereof.

Referring to FIG. 18, there is shown a pick-up cartridge which has the stylus assembly detachably located therein. The lead wires 4*a* and 5*a* extending from the coils 4 and 5 are guided along a pair of guide grooves 42 located on the peripheral surface of the cylindrical supporting member 15' in the longitudinal direction. The ends of the lead wires 4*a* and 5*a* are connected to four terminal pins 43 which are carried in a terminal casing 44. The terminal casing 44 is connected rigidly to the rear end of the cylindrical supporting member 15' and the four terminal pins 43 extending rearwardly from the terminal casing 44. A circuit plate 45 which is rigidly housed in the housing 28 of the cartridge has four openings or sockets 46 for fitting the four terminal pins 43 therein and four thin strips of metallic plate 47 are bonded on the circuit plate 45, a corresponding one extending from each of the four sockets 46. The free end of each of the metallic plates 47 which is remote from the socket 46 is electrically connected to a corresponding one of the terminal pins 29 by means of a lead line 48. A holder 49 made of synthetic resin or by light alloy is fixed to the supporting member 15' at the front portion of the supporting member 15'. In the case where the supporting member 15' is made of magnetic material, the holder 49 and the supporting member 15' can be integrally formed. According to the arrangement shown in FIG. 18, the holder 49 and the cylindrical supporting member 15' carrying the vibrating section may be secured in position by a securing screw 50 which is screwed into the housing 28 for tightly supporting the holder 49 so as to prevent resonance.

In the case where it is required to exchange the stylus assembly, the securing screw 50 is removed from the housing 28 and, the holder 49 is pulled in a direction away from the cartridge together with stylus assembly, coupling cantilever, supporting ring, coils, supporting member and terminals. A new stylus assembly carrying a new stylus 1 is then inserted into the cartridge and is secured in position by the insertion of the securing screw 50.

It is to be noted that the supporting members 15 or 15' which have been described as being shaped like a cylinder can be shaped in a box like configuration with a differently shaped holder and the stylus assembly may be so arranged as to be detached in a downward direction away from the cartridge.

Since the pick-up assembly of the present invention has the recess 25 formed in the front yoke 20, it is simple to position the vibrating section with coils in a desired position as compared with a conventional type of pick-up assembly which requires an additional step of insertion of the vibrating section into an opening formed in the front yoke.

Furthermore, since the permanent magnet or magnetized element and magnetic gap employed in the pick-up assembly of the present invention is separated from the surface of the record disk, the magnetic attractive force effected between these elements and the turn table which contains magnetic materials will be so small that the stylus pressure will not be disturbed by such a force and/or the elements will not collect tiny particles of magnetic material.

As it is described above, the pick-up assembly of the present invention eliminates all the disadvantages (a) to (g) described above in the summary of the invention. From the view point of its quality, the reproduction of the frequency range is widened without deteriorating the S/N ratio and, from the viewpoint of its structure, the coils 4 and 5 can be manufactured simply and separately from the support ring 3. Furthermore, since the coils 4 and 5 are formed in the shape of a ring, it becomes possible to manufacture the coils exactly in the same shape at low manufacturing cost. Therefore, the pick-up assemblies produced through automated mass-production will be of high quality.

Although the present invention has become fully described by way of examples with reference to the accompanying drawings, it is to be noted that various changes and modifications will be apparent to those skilled in the art. Therefore, such changes and modifications which do not depart from the true scope of the present invention should be construed as being included therein.

What is claimed is:

1. A pick-up assembly for use in a record player for reproducing monophonic or stereophonic audio information carried in a groove formed in a record disc, said pick-up assembly comprising;

a cantilever having one end portion thereof provided with a stylus;

a support ring for tightly supporting the other end of the cantilever in substantial alignment with the longitudinal axis of said cantilever;

a pair of ring-shaped coils rigidly mounted on said support ring with their longitudinal axes extending in parallel and equidistantly spaced relation to the longitudinal axis of said support ring, said coils on said support ring being contained in a plane which is substantially perpendicular to the axis of said support ring, and the respective centers of said ring shaped coils being angularly spaced at substantially right angles to each other about the longitudinal axis of said support ring;

a damper means located on the side of said ring shaped coils opposite to said cantilever and coaxial with said supporting ring;

a supporting means located on the side of said damper means oppposite to said ring shaped coils for supporting said support ring and a pair of poles having a circular cross-section and being made of magnetic material and each having the end portion coaxially inserted into corresponding ones of said pair of coils, and said damper means interposed between said support means and said support ring, for causing said coils to vibrate approximately about a point of intersection of the longitudinal axis of said support ring with said plane in response to a vibration of said cantilever caused by a movement of said stylus;

a first yoke member located above said ring shaped coils having a pair of leg portions depending from said first yoke member, said leg portions being positioned outside said pair of poles and spaced from said coils for forming a magnetic gap having a predetermined size between each of said respective leg portions and said poles, said first yoke member having a recess therein which is located above said stylus substantially in alignment with said coils in the direction transverse to said cantilever for increasing separation of said stereophonic audio information; and a permanent magnet means for magnetizing said leg portions in one of the magnetic polarities and for magnetizing said poles in the other magnetic polarity for establishing a magnetic field between each of said poles and said respective leg portions.

2. A pick-up assembly as claimed in claim 1 further comprising a second yoke member made of magnetic material located on the side of said supporting means opposite the location of said damping means for supporting said supporting means and connected to the portion of said permanent magnet means opposite to where said cantilever is located.

3. A pick-up assembly as claimed in claim 2, wherein said poles are an integral part depending from said second yoke member.

4. A pick-up assembly as claimed in claim 2, wherein said poles and said supporting means are an integral portion of said second yoke member.

5. A pick-up assembly as claimed in claim 2, wherein said poles are separate from and supported on said second yoke member.

6. A pick-up assembly as claimed in claim 1, wherein said ring shaped coils are resin impregnated and hardened for retaining their ring shape.

7. A pick-up assembly as claimed in claim 1, further comprising auxiliary poles attached to said supporting means and extending parallel and adjacent to said pair of poles, said auxiliary poles having the same magnetic polarity as the magnetic polarity of said pair of poles.

8. A pick-up assembly as claimed in claim 1 wherein said recess is a rectangular recess.

9. A pick-up assembly contained in a housing for use in a record player for reproducing monophonic or stereophonic audio information carried in a groove formed in a record disc, said pick-up assembly comprising:

a housing;

a cantilever having one end portion thereof provided with a stylus;

a support ring for rightly supporting the other end of said cantilever in substantial alighment with the longitudinal axis of said cantilever;

a pair of ring shaped coils rigidly mounted on said support ring with their longitudinal axes extending in parallel and equidistantly spaced relation to the longitudinal axes of said support ring, said coils on said support ring being contained in a plane substantially perpendicular to the axis of said support ring, and the respective centers of said ring shaped coils being angularly spaced at substantially right angles to each other about the longitudinal axis of said support ring;

a damper means located on the side of said ring shaped coils opposite to said cantilever and coaxial with said support ring;

a supporting means located on the side of said damper means opposite to said ring shaped coils for supporting said support ring and said damper means disposed between said supporting means and said support ring, for vibrating said coil approximately about a point of intersection of the longitudinal axis of said support ring with said plane in response to a vibration of the cantilever caused by movement of said stylus;

a pair of poles having a circular cross-section and made of magnetic material and having the end portion coaxially inserted into corresponding ones of said pair of coils;

a first yoke member made of magnetic material and having a recess defined by a pair of leg portions, said leg portions depending from said first yoke member and located substantially perpendicular to said pair of poles and spaced outside said coils for forming a magnetic gap having a predetermined size between each of said poles and said respective leg portions, said recess being substantially in alignment with said coils in the direction transverse to said cantilever for increasing separation of said stereophonic audio information;

a rear plate member located at the portion of said housing opposite to where said cantilever is located and having attached a second yoke member made of magnetic material and said pair of poles and said supporting means also rigidly attached to said rear plate member; and a permanent magnet positioned between said first and second yoke member for magnetizing said pair of poles in said second yoke member in one of the magnetic polarities and magnetizing said depending leg portions in the other magnetic polarity for establishing a magnetic field between said poles and said respective leg portions.

10. A pick-up assembly for use in a record player for reproducing monophonic or stereophonic audio information carried in a groove formed in a record disc, said pick-up assembly being received in a pick-up cartridge which is attachable to a pick-up arm through electrical connecting means, said pick-up assembly comprising a pick-up cartridge having received therein;

a cantilever having one end portion thereof provided with a stylus;

a support ring for tightly supporting the other end of said cantilever and substantially aligned with the longitudinal axis of said cantilever;

a pair of ring shaped coils rigidly mounted on said support ring with their longitudinal axes extending in parallel equidistantly spaced relation to the longitudinal axis of said support ring, said coils on said support ring being contained in a plane substantially perpendicular to the axis of said support ring, and the respective centers of said ring shaped coils being angularly spaced substantially at right angles to each other about the longitudinal axis of said support ring;

a damper means located on the side of said ring shaped coils opposite to said cantilever and coaxial with said support ring;

a supporting means located on the side of said damper means opposite to said support ring for supporting said damper means and said support rings for vibrating said coils approximately about a point of intersection of the longitudinal axis of said support ring with said plane in response to a vibration of said cantilever caused by movement of said stylus;

a holder means detachably connected to said cartridge for holding said supporting means;

a pair of poles having a circular cross-section and made of magnetic material and supported by said supporting means, each of said poles being positioned with the end portion of said poles coaxially inserted into each of said pair of coils;

a first yoke member made of magnetic material having a recess located at one edge thereof for inserting a pair of leg portions positioned perpendicularly to said pair of poles and spaced outside of said coils for forming a magnetic gap which has a predetermined size between each of said poles and said respective leg portions, said recess being substantially in alignment with said coils in the direction transverse to said cantilever for increasing separation of said stereophonic audio information;

a permanent magnet means rigidly supported in said cartridge, said pair of poles being detachably connected to said permanent magnet means and magnetized in an opposite magnetic polarity to that of said leg portions for establishing a magnetic field between each of said poles and said respective leg portions; and terminal means for electrically and detachably connecting said pair of coils to an electrical connecting means.

* * * * *